United States Patent [19]

White et al.

[11] 4,043,428

[45] Aug. 23, 1977

[54] AUTOMATIC RECYCLE CONTROL FOR HYDRAULIC ELEVATORS WITH TELESCOPIC CYLINDERS

[75] Inventors: Lawrence Eugene White, Harrington Park; Arthur Brantlyn Woolsey, Ridgewood, both of N.J.

[73] Assignee: Otis Elevator Company, New York, N.Y.

[21] Appl. No.: 639,520

[22] Filed: Dec. 10, 1975

[51] Int. Cl.[2] ..... F15B 11/18; F15B 13/16

[52] U.S. Cl. ..... 187/17; 187/34; 91/168; 91/189 R

[58] Field of Search ..... 91/168, 189 R, 189 A; 187/17, 34

[56] References Cited

FOREIGN PATENT DOCUMENTS

| | | | |
|---|---|---|---|
| 1,240,743 | 5/1967 | Germany | 91/168 |
| 877,869 | 9/1961 | United Kingdom | 91/168 |

*Primary Examiner*—Paul E. Maslousky

*Attorney, Agent, or Firm*—Robert T. Mayer; Richard T. Treacy

[57] ABSTRACT

Apparatus for automatically sensing when an insufficient amount of fluid exists in a closed fluid power transmission system of a telescoping piston type hydraulic elevator system and circuitry shown interconnected with the control system of a typical hydraulic control system for automatically initiating a fluid restoration cycle to restore fluid to that closed fluid power transmission system to enable the system to operate in a desired manner.

5 Claims, 4 Drawing Figures

AUTOMATIC RECYCLE CONTROL FOR HYDRAULIC ELEVATORS WITH TELESCOPIC CYLINDERS

This invention relates to a hydraulic system utilizing a telescoping piston arrangement actuated by an enclosed fluid power transmission system. More particularly it describes apparatus for automatically adding fluid to the enclosed fluid power transmission system to replace the fluid lost during operation of that system.

Hydraulically operated telescoping systems are widely used for lifting heavy loads. One particular and increasingly widespread use is for lifting the car in an elevator system. The use of the telescopic piston arrangement for elevator systems is becoming more widespread because of the increasing difficulty in assessing the cost of the single piston type arrangement so prevalently used in the past for hydraulic elevator systems. This difficulty is a consequence of the normal mounting of part or all of the load supporting piston cylinder as far beneath the lowest building floor level in which the system is installed as the highest landing is above that level. This type of mounting of the piston cylinder is occasioned by the requirement that the car, supported by a single piston, provide service for the upper and lower landings of the buildings.

Since the piston cylinder of the single plunger arrangement is positioned beneath the lowest building floor level, adequate support must be provided for that piston cylinger to which the system load is transmitted. However, because of the varied land conditions containing clay, sand or bedrock a variety of piston cylinder supports suitable as load supports must be provided. As a result, cost estimates for the single piston arrangement type of elevator system requires a prior knowledge of the area in which the installation is to be made and the related variable cost requirements of the piston cylinder supporting structure required.

An attendant problem of placing the piston cylinder beneath the lowest floor is corrosion of the piston cylinder. This corrosion problem is considered consequential because the corrosion of the piston cylinder continues unnoticed until the cylinder ruptures.

Because of the telescoping effect of the pistons of telescoping piston arrangement a car supported by the inner piston can provide service to the upper and lower landings of a building although the piston cylinder is mounted above the building floor level. In addition, because the piston cylinder is mounted above the building floor level, the building floor level provides the load support for the piston cylinder. Furthermore, because the piston cylinder is mounted above the building floor level, it is available for visual inspection thereby reducing the rupture hazard of the cylinder resulting from corrosion. However, the telescoping effect of the telescoping piston arrangement in which a plurality of pistons are movable relative to each other is achieved in a hydraulic system through the use of a plurality of seals which are placed between the movable pistons. Typically, the moving force of the inner pistons is applied to those pistons by means of a closed fluid power transmission system forming part of the hydraulic system which transmits that force as a result of an external force applied to it. Because the moving force of the inner pistons is transmitted by means of a closed fluid power transmission system any leakage of the fluid contained in that system results in unsatisfactory performance of an elevator system. Loss of fluid prevents the car from reaching the uppermost landing within the desired degree of accuracy. Consequently, the telescoping piston arrangement utilizing a plurality seals each of which is subject to fluid leakage to enclose the fluid power transmission system requires constant maintenance to insure adequate performance of the elevator system. Such maintenance is expensive because an attendent is required to turn off the system, add hydraulic fluid to the closed fluid power transmission system and then to restore the elevator system to its normal operation each time an insufficient amount of fluid exists in that system.

It is therefore an object of this invention to provide an improved hydraulically actuated telescoping piston type elevator system.

Another object of this invention is to provide apparatus which automatically adds fluid to a closed hydraulic fluid power system of a hydraulically actuated telescoping piston type elevator system when insufficient amount of fluid exists in that system.

An improved hydraulic system having a telescoping piston arrangement is described. The telescoping piston arrangement includes an outer cylinder opened at one end which contains hydraulic fluid. An intermediate piston positioned within and extendible from the opened end of the hydraulic cylinder has a first pair of seals placed between it and the outer cylinder forming therebetween an outer longitudinal hydraulic fluid containing chamber. A hollow inner piston closed at one end forming an inner hydraulic fluid containing chamber is positioned within and extendible from the intermediate piston and has a second pair of seals placed between it and the intermediate piston forming therebetween an intermediate longitudinal hydraulic fluid containing chamber. Communication between each of the chambers is established by providing a passage through each of the pistons whereby fluid flows between the chambers. A hydraulic valve assembly also forming part of the telescoping piston arrangement is mounted on the lower end of the intermediate piston. When the valve is operated to its closed position it forms with the outer cylinder wall a lower chamber within the outer cylinder for receiving hydraulic fluid and separates therefrom the fluid containing outer longitudinal, intermediate longitudinal and inner chambers thereby forming therein a closed power transmission system. The hydraulic valve is also operable to a second position to permit transfer of hydraulic fluid from the lower chamber to the inner chamber of the inner piston. Hydraulic control means are connected to the outer cylinder chamber of the telescoping piston arrangement to selectively control the amount and the direction of fluid flow therebetween in response to signals applied to the hydraulic control means by a power control means. A detection means is also provided which in response to the distance between the inner and the intermediate pistons being less than a predetermined distance when the inner piston is positioned at a preset location, operates to produce a signal signifying that an insufficient amount of fluid exists within the closed fluid power transmission system for the proper operation of the elevator system. An automatic fluid restoration means is also provided as part of this invention and operates in response to the signal from the detection means to initiate a fluid restoration cycle in which the hydraulic valve is actuated to a position at which hydraulic fluid is added to the inner chamber of the inner piston and to subsequently cause the inner piston to return to its preset location after the fluid restoration cycle is completed.

Additional objects, features and advantages of the invention will be apparent from the following description and the appended claims when considered in conjunction with the accompanying drawing in which:

Figure 1:
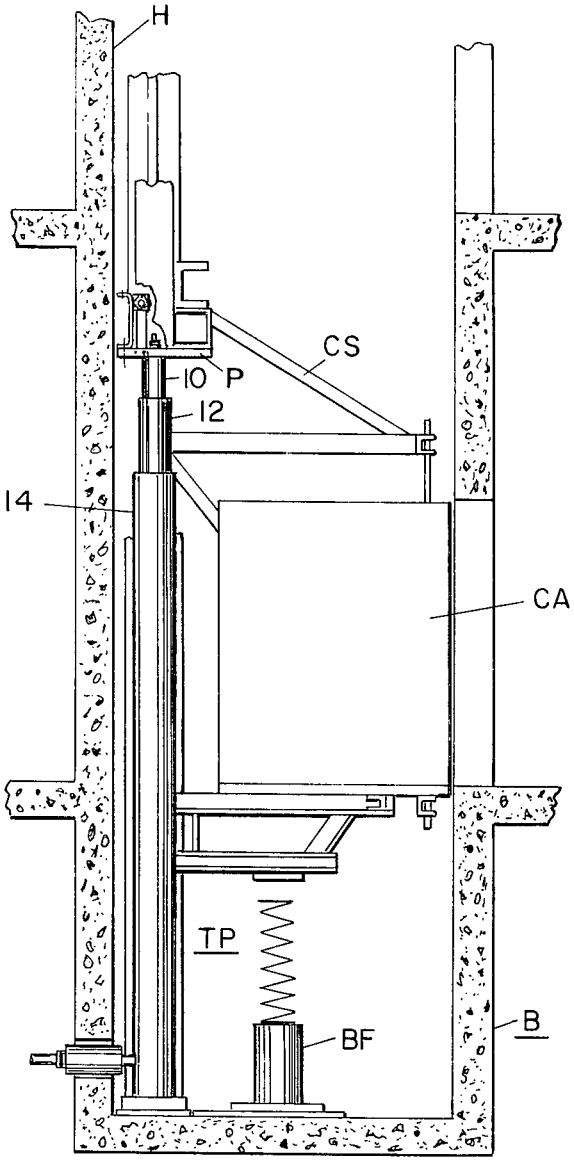
FIG. 1 is a simplified side elevation view of a hydraulically operated elevator system.

Illustrated in FIG. 1 of the drawing is an elevator car CA located at the first landing of building B. The car is fastened to cantilever support CS which is supported by platen P mounted on the top of inner piston 10. Inner piston 10 is shown positioned within and extending from intermediate piston 12. Similarly intermediate piston 12 is illustrated as positioned within and extending from outer cylinder 14. The inner piston, intermediate piston and outer cylinder form a telescoping piston arrangement TP which is bolted to the floor of the building. A car buffer BF is also supported by the floor of the building in any well-known manner.

Figure 2:
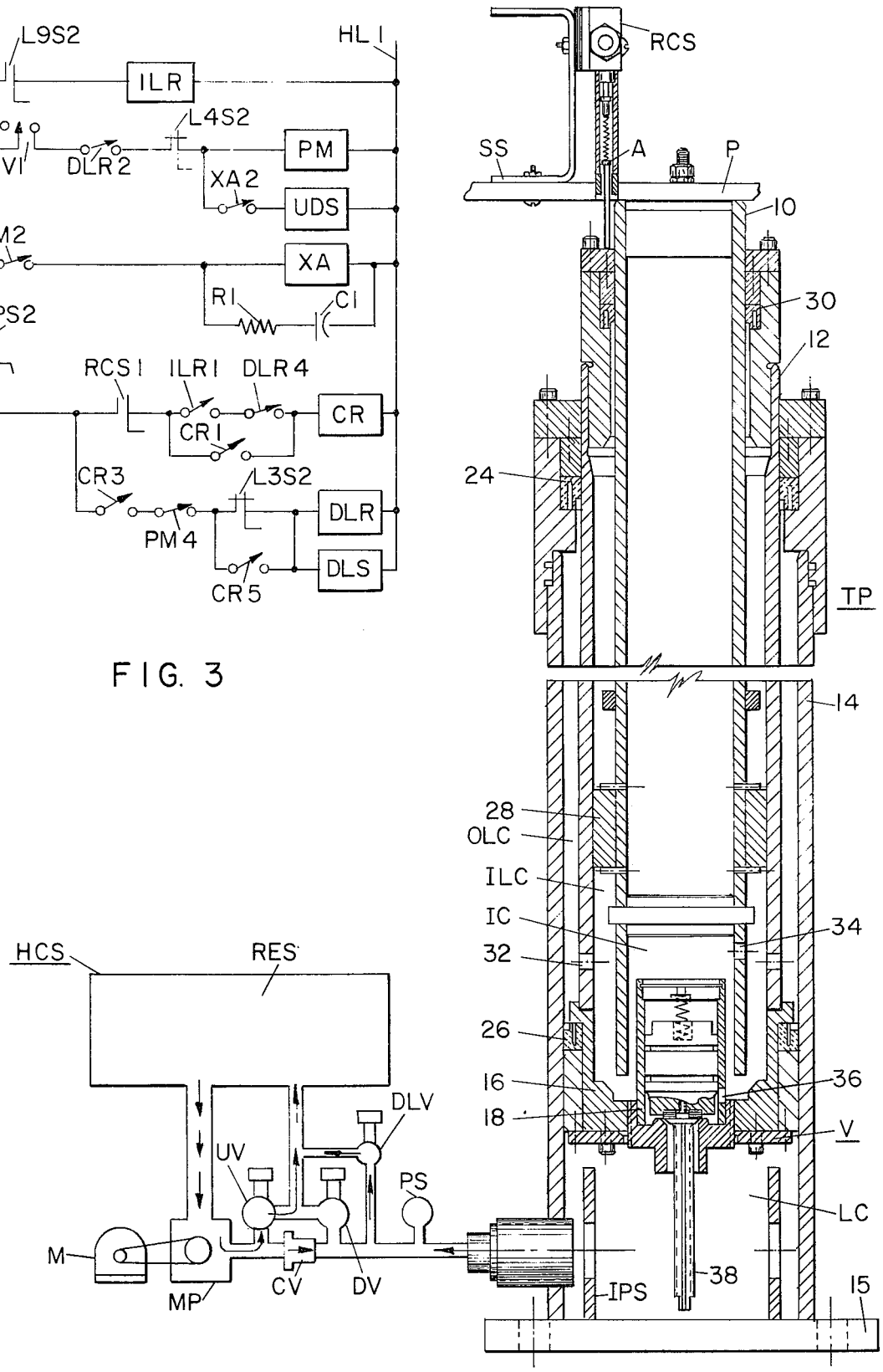
FIG. 2 illustrates a sectional view of the telescoping piston arrangement of the elevator system shown in FIG. 1 hydraulically connected to a typical hydraulic control system operated by a typical electrical control system of the invention.

A sectional view of the telescoping piston arrangement TP illustrated in FIG. 1 is shown in FIG. 2 connected to a schematic representation of hydraulic control system HCS. Hydraulic control system HCS is connected to electrical control equipment of FIG. 3 as is well-known to permit desired operation of this system.

Also shown in FIG. 2 is recycling switch RCS which in the disclosed constructed embodiment is a microswitch. This switch is fastened to a slotted support SS for vertical adjustment. As shown, the slotted support is bolted to the platen P. In addition fastened to the switch is an actuator assembly A comprising a spring plunger arrangement. The plunger of the actuator assembly is shown in FIG. 2 extending to and in contact with the top of the intermediate piston 12. Switch RCS and actuator assembly A are adjusted so that intermediate piston 12 causes the actuator assembly to actuate switch RCS to its closed position whenever the car is located at the first landing and the distance between the top of the inner and intermediate pistons is less than a predetermined distance.

The lower end of vertically positioned outer cylinder 14, supporting the intermediate and inner pistons, is secured to mounting plate 15 bolted to the floor of the building. Intermediate piston 12 vertically positioned within and extending from the upper opened end of outer cylinder 14 is fastened at its lower end to hydraulic valve assembly V. The hydraulic valve assembly comprises valve mount 16 and hydraulic valve 18 shown actuated to its closed position thereby forming lower chamber LC within outer cylinder 14 for receiving hydraulic fluid from hydraulic control system HCS. An intermediate piston support IPS is shown in FIG. 2 positioned within the lower chamber LC of outer cylinder 14 and mounted on the mounting plate 15.

A first pair of seals 24 and 26 is placed between the inner surface of the outer cylinder and the outer surface of the intermediate cylinder forming therebetween fluid containing outer longitudinal chamber OLC. Upper seal 24 is conveniently fastened to the interior surface of the outer cylinder while lower seal 26 is affixed to hydraulic valve assembly V secured to the lower end of the intermediate cylinder.

An inner piston 10 is shown positioned within and extending from the upper end of intermediate piston 12. A second pair of seals 28 and 30 is placed between the interior surface of the intermediate piston and the exterior surface of the inner piston. Lower seal 28 forms an upper third side of a fluid containing interior longitudinal chamber ILC located between the outer surface of inner piston 10 and the inner surface of intermediate piston 12. Lower seal 28 is conveniently fastened to the outer surface of the inner piston and upper seal 30 is affixed to the inner surface of intermediate piston 10.

Aperture 32 in the wall of intermediate piston 12 provides a passage which permits transfer of fluid between outer longitudinal chamber OLC and inner longitudinal chamber ILC. Inner piston 10 can be of a hollow type capped only at its upper end or as shown can be capped at its upper end and at a point between the upper and lower end so as to provide a lower fluid filled inner chamber IC. Aperture 34 in the side wall of inner piston 10 provides a passage which permits transfer of fluid between the inner chamber IC and the intermediate longitudinal chamber ILC.

Fluid containing outer longitudinal chamber OLC, inner longitudinal ILC and inner chamber IC form a closed fluid power transmission system when hydraulic valve 18 is actuated to its closed position as shown in FIG. 2. Although not shown, it is to be understood that hydraulic valve 18 shown in the closed position in FIG. 2 is of the pressure actuated variety and that its plunger 38 is actuated to an open position when the pressure head of the fluid contained in lower chamber LC exceeds the pressure head of the closed fluid power transmission system. When plunger 38 is actuated to the open position fluid is enabled to flow from lower chamber LC of the outer cylinder into hydraulic valve 18 and from the valve opening 36 located on the sidewall of hydraulic valve 18 into the closed fluid power transmission system.

Hydraulic control system HCS comprises a motor M connected to motor driven pump MP. Motor driven pump MP has its input port connected to fluid reservoir RES and its output port connected to the input port of up valve UV and to check valve CV. The output port of the check valve and each of the input ports of down leveling valve DLV and down main valve DV are hydraulically connected to lower chamber LC formed by outer cylinder 14. As illustrated in FIG. 2 a pressure switch PS is mounted on the hydraulic line interconnecting the hydraulic control system and the outer cylinder 14. The output ports of up valve UV, down leveling valve DLV and down valve DV are all connected along the same line to hydraulic fluid reservoir RES.

Figure 3:
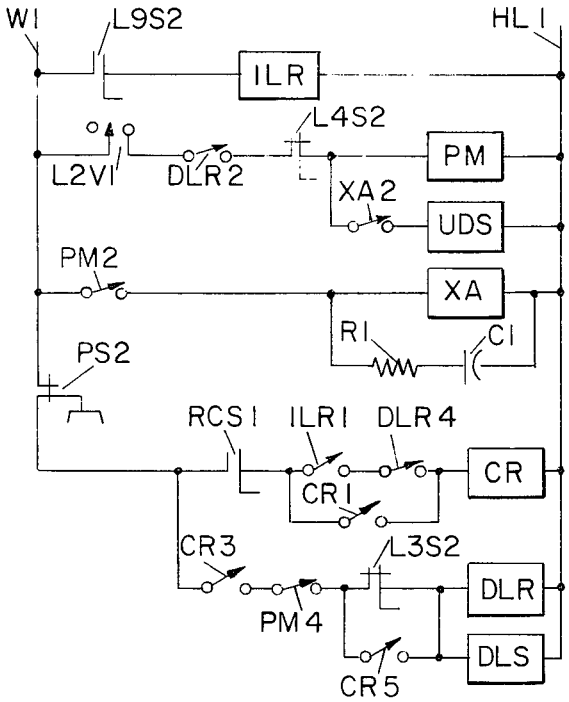
FIG. 3 is a simplified schematic wiring diagram of the electrical control system employed with the hydraulic control system of the invention.

The schematic diagram shown in FIG. 3 of the simplified electrical control system of the present invention includes the normally opened contacts L9S2 of a typical down direction slowdown limit switch connected in series with coil 1LR of the first landing relay across supply lines W1 and HL1. Also connected across those lines is a series circuit comprising contacts L2V1 of a typical up leveling creepage switch, normally closed contacts DLR2 of a down leveling valve relay, the normally closed contacts L4S2 of an up direction limit switch and the parallel arrangement of the coil PM of the pump motor switch and the coil UDS of the up dump solenoid in series with the normally closed contacts XA2 of an accelerating relay. The coil XA of the accelerating relay is connected in series with the normally closed contacts PM2 of the pump motor switch across the supply lines W1 and HL1. In addition, the coil XA has a typical resistor-condenser delay circuit R1-C1 connected across it.

In the described embodiment a pressure switch PS (FIG. 2) is mounted in the hydraulic line connecting the hydraulic system and the telescoping piston arrangement. The normally closed contacts PS2 (FIG. 3) of that switch are connected from line W1 in series with contacts RCS1 of the recycling switch RCS (FIG. 2) and series connected contacts 1LR1 of the first landing relay and DLR4 of the down leveling relay to one side of the coil CR of a correction relay, the other end of which is connected to line HL1. Contacts CR1 of the correction relay are connected in parallel with the series connected contacts 1LR1 and DLR4 to form a self holding circuit for that relay. Contacts PS2 also connect supply line W1 to series connected contacts CR3 of the correction relay and PM4 of the pump motor switch which are joined to the parallel connected contacts L3S2 of a down direction limit switch and the normally open contacts CR5 of the correction relay. These circuits are connected to one side of coils DLR and DLS of a down leveling valve relay and a down leveling solenoid respectively. The second side of each of the coils is connected to the HL1 line.

To more fully appreciate the invention and the manner in which it cooperates with a typical hydraulic elevator system to automatically restore fluid to a telescoping piston arrangement of that system, it will be assumed that as illustrated in FIG. 1 the car is positioned level with the first landing. As a result, contacts L9S2 of the down direction slow down limit switch are closed completing the energizing circuit of the coil 1LR of the first landing relay. In addition, the arm of up leveling creepage switch L2V1 is actuated to the center position when the car is at the first landing and as a result coil PM is deenergized and contacts PM2 are closed completing the circuit to the coil XA of the accelerating relay which is actuated to its operated position. Furthermore the contacts PS2 of the pressure switch PS (FIG. 2) are closed because of the pressure existing in the hydraulic line connecting the hydraulic control system and the outer cylinder. This pressure exists because the fluid in the lower chamber LC of the cylinder is supporting the load.

Under these circumstances, the circuits of the control system as described above are in their normal operational mode. However, for purposes of illustration, it will be assumed that an insufficient amount of fluid exists within the closed fluid power transmission system of the outer longitudinal chamber OLC, intermediate longitudinal chamber ILC and inner chamber IC of the telescoping piston arrangement and as a result when the telescoping piston arrangement is extended by the closed fluid power transmission system the car cannot attain the top landing of the building. Because this insufficiency of fluid exists, the distance between the tops of the inner and intermediate pistons is less than the predetermined distance when the car is at the lower terminal as is assumed. As a result, the contacts RCS1 of the recycling switch (FIG. 2) close.

As a result of the contacts RCS1 being actuated to the closed position, the circuit shown schematically in FIG. 3 connecting line W1, contacts PS2, the series connected contacts RCS1, 1LR1 and DLR4 is completed energizing the coil CR of the correction relay. The correction relay is thereby actuated to its operated position and closes contacts CR1 to maintain coil energized. Contacts CR3 and CR5 of the operated correction relay are also closed to energize the coils DLR and DLS of the down leveling valve relay and the down leveling solenoid. When the down leveling solenoid is energized, it actuates the down leveling valve DLV to its open position; fluid passes from the lower chamber LC of the outer cylinder, through the down leveling valve into the reservoir RES. Simultaneously, the down leveling relay being actuated to its operated position opens contacts DLR2. As a result, when the car leaves the first landing thereby actuating the arm of the up leveling creepage switch to close its contacts L2V1 in the circuit of coil PM of the pump motor switch it is without effect at this time since contacts DLR2 are actuated to their open position.

As the car descends from the first landing toward buffer BF (FIG. 1), the down direction slow down limit switch is actuated to open contacts L9S2. As a result, the coil 1LR of the first landing relay is deenergized and the relay transfers its contacts 1LR1 to the open position. The opening of contacts 1LR1 is ineffective at this time because the closed contacts CR1 of the correction relay act as a self-holding circuit for that relay. The car continues in a down direction toward the buffer assembly supported by the building floor.

Figure 4:
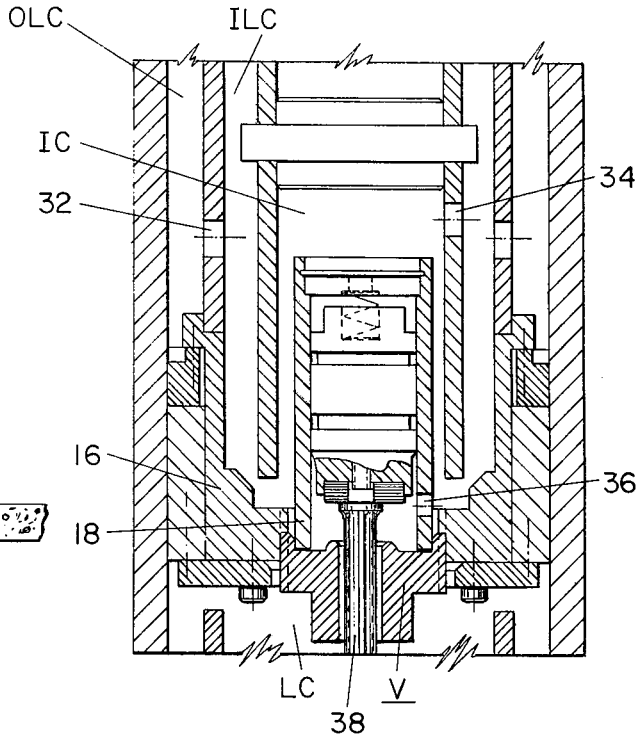
FIG. 4 is a sectional view of the hydraulic valve in an open position.

As the car continues in the down direction the inner piston 10 is retracted within the intermediate piston 12 which is also retracted within the outer cylinder 14. Before the car engages the buffer the inner piston engages and is supported by the valve assembly fastened to the lower end of intermediate piston. The load is thereby transferred from the closed fluid power transmission system directly to the intermediate piston supported by the fluid in the lower chamber LC. Consequently the fluid in the closed fluid power transmission system is at atmospheric pressure level and is less than the pressure of the load supporting fluid in the lower chamber LC. As a result the hydraulic valve 18 as is well known is actuated to its second or opened position (FIG. 4) against the pressure of a spring (shown but not labelled) which tends to maintain it closed. As a result fluid flows from the lower chamber LC of the outer cylinder 14 into the valve assembly through the opening 36 (FIGS. 2 and 4) in the valve sidewall into the fluid power transmission system of the inner chamber IC, intermediate longitudinal chamber ILC and outer longitudinal chamber OLC, thereby restoring the deficiency of the fluid existing therein. Subsequently the car engages the buffer and the car and inner piston comes to rest supported by the buffer BF (FIG. 1), however the intermediate piston continues to move in the same direction because of its own weight until it is seated on the intermediate piston support IPS (FIG. 2). When the intermediate piston comes to rest on the intermediate piston support plunger 38 engages mounting plate 15 maintaining valve 18 in its opened position. The fluid in the lower chamber no longer supports the intermediate piston and its pressure is reduced to the atmospheric pressure level thereby causing the pressure switch PS (FIG. 2) to actuate its contacts PS2 (FIG. 3) to the opened position. Opening contacts PS2 interrupts the energizing circuits of the coils CR, DLR and DLS of the correction relay, down leveling valve relay and down leveling solenoid respectively. The down leveling solenoid operates to release the down leveling valve which returns to its normally closed position.

When the contacts DLR2 return to their closed position, the energizing circuit of the coil PM of the pump motor relay is completed. The contacts of the pump motor relay are actuated to the operated position to energize the motor circuits (not shown) of the pump motor in any well-known manner and in addition, contacts PM2 open to deenergize the coil of the accelerating relay XA. After a sufficient time has elapsed to permit the motor M to attain its running speed, the accelerating relay releases to its unoperated position. When the contacts XA2 of the relay close, a circuit is completed to the coil UDS of the up dump solenoid. As a result, the solenoid actuates the up valve to the closed position and fluid flows from the reservoir through the pump MP and check valve CV into the lower chamber LC of the outer cylinder. The fluid entering the lower chamber LC passes through valve 18 filling the longitudinal chambers and subsequently causes the intermediate cylinder to move away from the intermediate piston support. As a result plunger 38 is disengaged from mounting plate 15 and the pressure level of the fluid in the lower chamber LC no longer exceeds the pressure level of the fluid in chambers OLC, ILC and IC and hydraulic valve 18 (FIG. 2) is closed by operation of its previously mentioned spring (shown but not labelled). Subsequently the car fastened to the inner piston leaves the buffer and moves in synchronism with the intermediate piston toward the first landing closing the down direction limit switch contacts L9S2. This completes the energizing circuit of the coil 1LR of the first landing relay and the relay is actuated to its operated position.

When the car arrives at the first landing, it actuates the arm of the up leveling creepage switch L2V1 to the center position and as a result, the energizing circuit of the coils PM and UDS of the pump motor relay and up dump solenoid are interrupted. The up dump solenoid actuates the up hydraulic valve to its open position and the remaining fluid in the pump is passed into the reservoir. The motor circuits (not shown) are deenergized in any well-known manner and with the fluid restored to the closed fluid power transmission system the car is once again capable of being moved to within the desired distance of the top terminal landing.

From the foregoing it will be understood that an insufficient amount of fluid existing in the closed fluid power transmission system of a telescoping hydraulic elevator system thereby preventing the car from reaching the uppermost landing of the building within a desired degree of accuracy is sensed to automatically initiate fluid restoration cycle. As a result fluid is automatically restored to the closed fluid power transmission system thereby enabling the car to reach the uppermost landing in the desired manner.

It is understood that additional contacts of the correction relay are employed in the safety circuits and the call registering circuits associated with a typical power control system of the hydraulic elevator system to prevent undesired operation during the recycling operation. In the interest of brevity these arrangements have not be illustrated.

It is apparent that various modifications of the above will be evident to those skilled in the art and that the arrangement described herein is for illustrative purposes and is not to be considered restrictive.

What is claimed is:

1. Apparatus for use with a hydraulic fluid elevator system operating an elevator car serving a plurality of landings and capable of causing the car to position itself at its lowest landing comprising:

a hydraulic telescoping piston arrangement having an outer cylinder, an intermediate piston and an inner piston supporting said car, said inner piston hydraulically sealed within and extendible from said intermediate piston and said intermediate piston hydraulically sealed within and extendible from said outer cylinder forming therein communicable longitudinal chambers containing a first body of hydraulic fluid;

hydraulic control means including a source of hydraulic fluid connected to said outer cylinder for transferring hydraulic fluid thereto from said source causing said intermediate piston and said inner piston to move relative to said outer cylinder;

a hydraulic valve assembly mounted on one end of said intermediate piston within said outer cylinder forming therein a lower chamber for receiving transferred hydraulic fluid from said source, said hydraulic valve assembly operable to a first position for separating said fluid containing communicable longitudinal chambers from said lower chamber thereby forming within said longitudinal chambers a closed fluid power transmission system operable to move said inner piston relative to said intermediate piston in response to the transfer of fluid between said hydraulic control means and said lower chamber, and said valve assembly operable to a second position for transferring hydraulic fluid between said fluid containing longitudinal chambers and said lower chamber; and power control means responsive to the location of said car at its lowest landing actuating said hydraulic control means to cause said intermediate and inner piston to move downwardly relative to said outer cylinder to operate said hydraulic valve assembly to its second position to cause transferred hydraulic fluid to be supplied from said source through said lower chamber to said fluid containing longitudinal chambers when an insufficient amount of fluid exists within said longitudinal chambers, and to return said elevator car to its lowest landing when said fluid insufficiency no longer exists.

2. Apparatus according to claim 1, wherein said power control means includes sensing means operable when said car is at its lowest landing automatically sensing when an insufficient amount of fluid exists within said fluid containing longitudinal chambers to enable said elevator car to operate in a desired manner.

3. Apparatus according to claim 2, wherein said sensing means operates in response to the distance between the top of said inner piston and the top of said intermediate piston being less than a predetermined distance when said intermediate piston is at a preset location, said sensing means thereupon producing a signal signifying that an insufficient amount of hydraulic fluid exists within the closed fluid power transmission system.

4. Apparatus according to claim 3, wherein said power control means includes switching means operative in response to said signal signifying that an insufficient amount of hydraulic fluid exists within said closed fluid power transmission system to cause said elevator system to cease the normal elevator operation, to initiate a fluid restoration cycle in which said hydraulic valve assembly is operated to its second position to enable hydraulic fluid to be transferred from said hydraulic system to said longitudinal chambers, said power control means also including a pressure switch connected between said hydraulic control means and said outer cylinder operative to cause said switching means to restore said elevator system to the normal elevator operation when said fluid restoration cycle is complete.

5. An improved hydraulic system of the type having:

a telescoping piston arrangement including:

an outer cylinder closed at one end, opened at its other end;

an intermediate piston positioned within and extendible from the open end of said outer cylinder;

a pair of seals placed between said outer cylinder and said intermediate piston forming therebetween an outer longitudinal chamber containing a portion of a first body of hydraulic fluid;

a hollow inner piston positioned within and extendible from said intermediate piston, said inner piston closed at its upper end and forming an inner chamber containing another portion of said first body of hydraulic fluid;

another seal placed between said inner piston and said intermediate piston forming therebetween an intermediate longitudinal chamber containing the remainder of said first body of hydraulic fluid, said intermediate longitudinal chamber in communication with said outer longitudinal chamber and said inner chamber to enable hydraulic fluid flow between each of said chambers;

a hydraulic valve assembly mounted on one end of said intermediate piston within said outer cylinder forming therein a lower chamber for receiving hydraulic fluid and operable to a first position in which said outer longitudinal chamber, said intermediate longitudinal chamber and said inner chamber form a closed fluid power transmission system;

said valve assembly being operable to a second position to connect hydraulically said lower chamber to said inner chamber;

hydraulic control means including a source of hydraulic fluid connected to said outer cylinder of said telescoping piston arrangement for transferring hydraulic fluid to said lower chamber from said source causing said intermediate piston and said inner piston to move relative to said outer cylinder;

power control means connected to said hydraulic control means for selectively actuating said hydraulic control means to control the amount and direction of the hydraulic fluid transfer between said hydraulic control means and said lower chamber; wherein the improvement comprises:

sensing means operable in response to the distance between said inner piston and said intermediate piston being less than a predetermined distance when said inner piston is positioned at a preset location, said sensing means thereupon producing a signal signifying that an insufficient amount of hydraulic fluid exists within the closed fluid power transmission system; and automatic fluid restoration means connected to said power control means and operable in response to said signal from said sensing means to cause said power control means to cease its normal operation, to initiate a fluid restoration cycle in which said inner piston and said intermediate piston are moved to a position within said outer cylinder at which position said hydraulic valve assembly is operated to its second position to enable hydraulic fluid to be transferred from said source through said lower chamber to said inner chamber and subsequently to return said inner piston to its preset location when said fluid restoration cycle is complete.

* * * * *